US007926142B2

(12) United States Patent
Bizzotto

(10) Patent No.: US 7,926,142 B2
(45) Date of Patent: Apr. 19, 2011

(54) TWIST MOP WITH RETAINING CLIP

(75) Inventor: Marco Bizzotto, Padua (IT)

(73) Assignee: The Libman Company, Arcola, IL (US)

( * ) Notice: Subject to any disclaimer, the term of this patent is extended or adjusted under 35 U.S.C. 154(b) by 720 days.

(21) Appl. No.: 11/757,116

(22) Filed: Jun. 1, 2007

(65) Prior Publication Data

US 2007/0277337 A1 Dec. 6, 2007

Related U.S. Application Data

(60) Provisional application No. 60/803,691, filed on Jun. 1, 2006.

(51) Int. Cl.
*A47L 13/142* (2006.01)

(52) U.S. Cl. ..... 15/120.1; 15/229.1

(58) Field of Classification Search ..... 15/120.1, 15/120.2; 24/458, 545, 711.1; 403/109.1–109.8; *A47L 13/142*
See application file for complete search history.

(56) References Cited

U.S. PATENT DOCUMENTS

| | | | | | |
|---|---|---|---|---|---|
| 639,337 | A | * | 12/1899 | Anthony | 403/155 |
| 1,514,051 | A | | 11/1924 | Jumonville | |
| 1,520,500 | A | | 12/1924 | Jumonville | |
| 2,495,846 | A | | 1/1950 | Johnson | |
| 4,479,278 | A | | 10/1984 | Heinonen | |
| 5,509,163 | A | * | 4/1996 | Morad | 15/120.2 |
| 5,566,417 | A | | 10/1996 | Hsieh | |
| 5,642,551 | A | | 7/1997 | Cann et al. | |
| 5,675,858 | A | | 10/1997 | von Meyer | |
| 5,722,105 | A | | 3/1998 | Thomasson | |
| 5,850,658 | A | | 12/1998 | Specht | |
| 5,890,253 | A | * | 4/1999 | Morad | 15/120.1 |
| 6,115,869 | A | | 9/2000 | Libman | |
| RE38,380 | E | | 1/2004 | Libman et al. | |
| 7,278,693 | B2 | * | 10/2007 | Smith et al. | 301/113 |
| 7,360,286 | B2 | * | 4/2008 | Shimizu | 24/555 |

OTHER PUBLICATIONS

Chinese Foreign Office Action in corresponding Application No. 2007101421436 mailed Sep. 10, 2010.

* cited by examiner

*Primary Examiner* — Monica S Carter
*Assistant Examiner* — Stephanie Newton
(74) *Attorney, Agent, or Firm* — Banner & Witcoff, Ltd.

(57) ABSTRACT

A twist mop is disclosed. The twist mop includes a handle with a recessed first end that includes a hole. The twist mop includes a collar that can rotate around the handle. Mop fibers are coupled to a connector that inserts into the recessed end of the handle and are also coupled to a collar that is rotatably mounted to the handle. The connector also includes a hole. A retaining clip is provided to insert in the hole in the handle and in the hole in the connector so as to prevent the connector from becoming inadvertently disconnected from the handle. The retaining clip includes a tab with a gripping surface that may be concave to facilitate improved removal of the retaining clip. The tab may also include angled side walls.

16 Claims, 11 Drawing Sheets

TWIST MOP WITH RETAINING CLIP

CROSS REFERENCE TO RELATED APPLICATIONS

This application claims priority to Provisional Application Ser. No. 60/803,691, filed Jun. 1, 2006, which is incorporated by reference in its entirety herein.

BACKGROUND OF THE INVENTION

1. Field of the Invention

The present invention relates to the field of wringer mops and more particularly to the field of so-called twist mops.

2. Description of Related Art

In a twist mop, one end of the mop fibers is fixably attached to an end of a mop handle and the other end of the mop fibers is attached to a collar that is rotatably mounted to the mop handle. By rotating the collar around the handle in one direction, the mop fibers can be wrung out. Certain features allow the twist mop to be more effective. For example, U.S. Pat. No. RE38,380 describes a method of preventing a collar from inadvertently unwinding while wringing the mop fibers.

Because the mop fibers tend to be subjected to relatively harsh environments, on occasion it may be desirable to replace the mop fibers. To facilitate this possibility, one end of the mop fibers can be coupled to a connector which is mounted on the end of the mop handle. The connector can be configured with a strap that wraps around the fibers and secures them to a base. A stem may extend from the base and be configured to be inserted into the end of the handle. For example, U.S. Pat. No. 6,321,409 provides details of a design that may be used with a connector and is incorporated herein by reference in its entirety. In operation, the connector can be pulled out of the end of the handle, the mop fibers removed from the collar, and the mop fibers replaced on the collar and handle.

As can be appreciated, it is undesirable for the connector to inadvertently become detached, particularly during vigorous mopping or wringing actions, and therefore the connector is mounted to the handle in a manner that resists detachment. While existing designs for connectors provide for the possibility for removal of the connector, and thus the replacement of the mop fibers, further improvements are desirable.

BRIEF SUMMARY OF THE INVENTION

A twist mop includes a handle with a first end configured to accept a connector. Mop fibers are coupled to a connector that inserts into the handle on the first end and are also coupled to a collar that is movably mounted to the handle. The handle end and the connector include corresponding holes that are aligned when the connector is positioned in the handle. A retaining clip includes a post extending from a semi-circular band and a gripping tab, and the post may be inserted into the aligned holes so as to limit axial movement or rotation of the connector to restrain the connector from becoming detached from the handle. In operation, the semi-circular band holds the retaining clip in position. A user may grasp the gripping tab and remove the retaining clip. In an embodiment the gripping tab may include concave surfaces to facilitate gripping.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
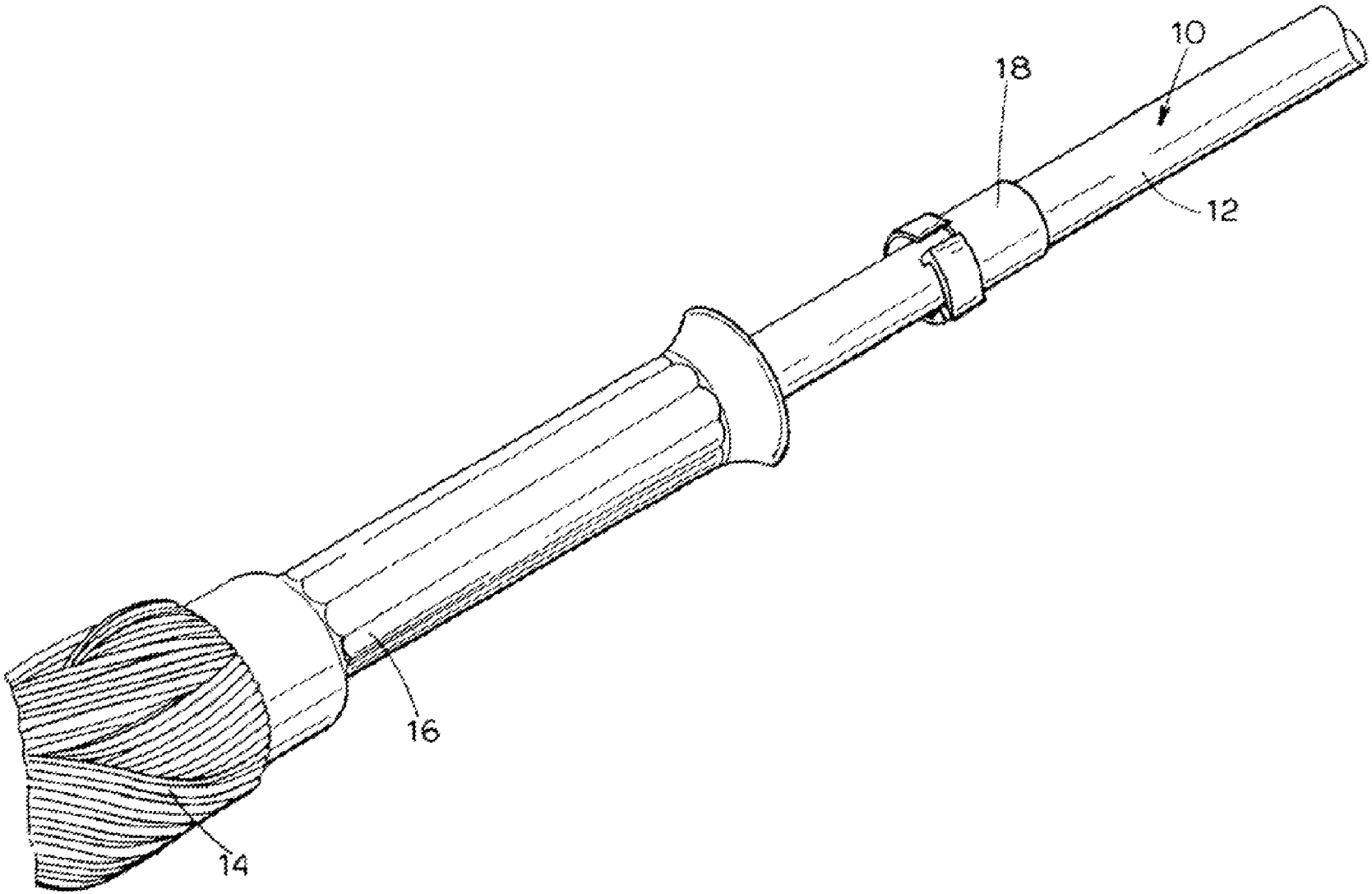
FIG. 1 is an isometric partial view of an illustrative embodiment of a twist mop.

FIG. 1 illustrate details of an embodiment of a twist mop 10 that is configured to allow a user, when wringing out the mop fibers, to twist and release a collar 16 without the collar 16 inadvertently untwisting when the user releases it. The collar 16 includes ribs on an inner diameter (not shown) that may engage a ratcheting bracket 18 so that the collar 16 can only be twisted in one direction. While not required, such a design as disclosed in U.S. Pat. No. RE38,380, incorporated herein by reference in its entirety, allows a user to more thoroughly wring mop fibers 14 of the twist mop 10.

Figure 2:
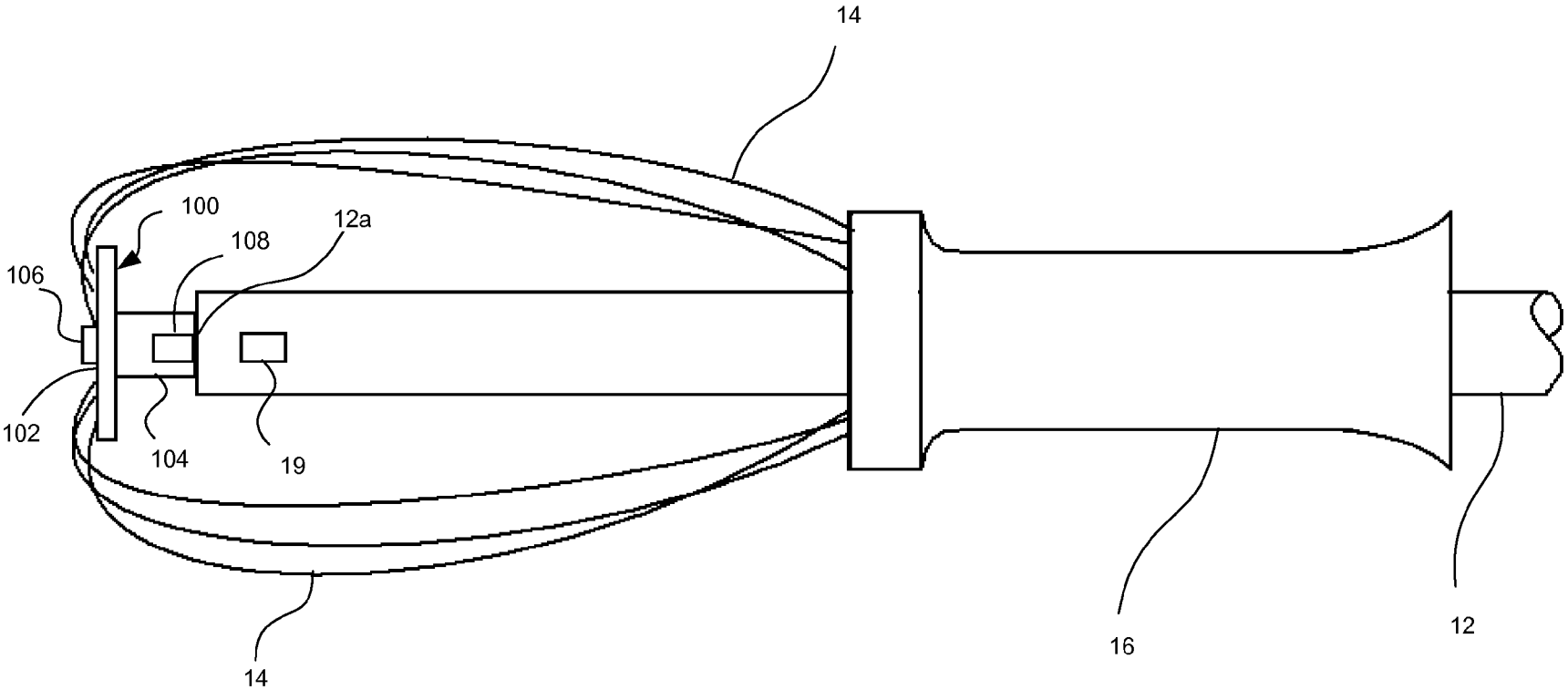
FIG. 2 is a schematic view of an embodiment of a connector configured to be inserted in a handle.
Figure 5:
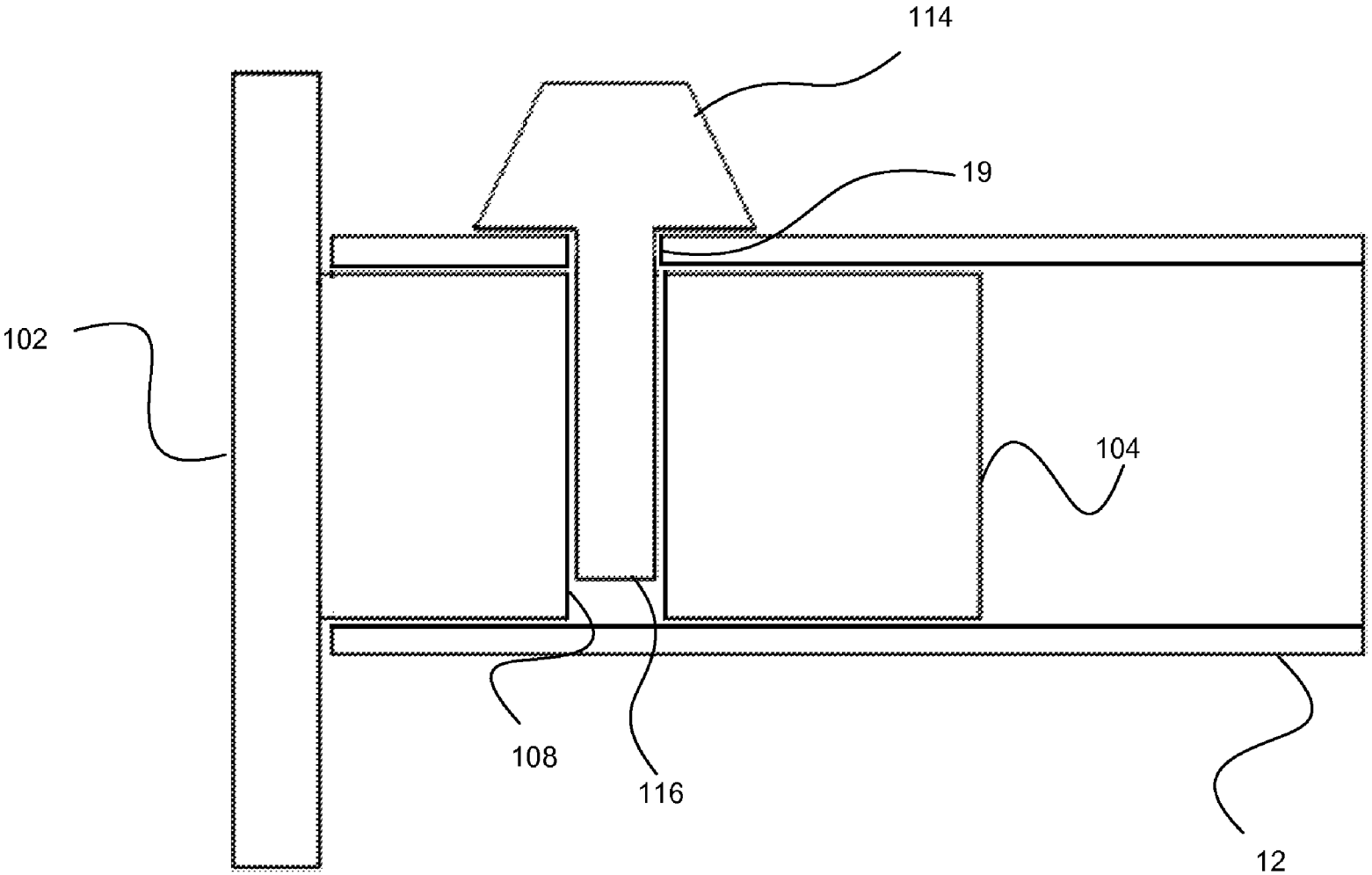
FIG. 5 is a schematic partial cross section of retaining clip engaging a handle and a connector.
Figure 6:
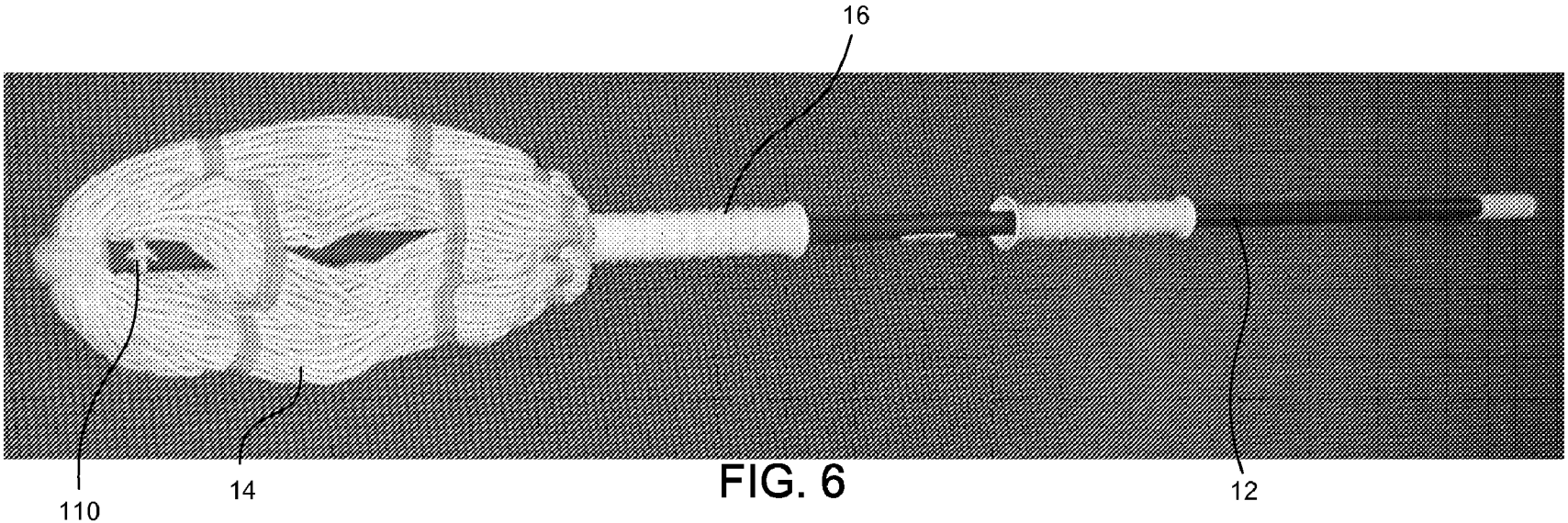
FIGS. 6-9 are isometric views of an illustrative embodiment of a twist mop with a retaining clip.

To assemble a twist mop 10, the collar 16 may be inserted over an end 12*a* of a handle 12 and slid down as depicted in FIGS. 2 and 6. A connector 100 may be mounted to the end 12*a* of the handle 12. In an embodiment, the connector 100 includes a stem 104 that inserts into the handle 12 (which may be hollow or have a recess at the end 12*a*) so that a hole 108 through the stem 104 aligns with a hole 19 in the handle 12. In an embodiment, the alignment of the holes 19, 108 may occur when the stem 104 is inserted into the handle 12 until the connector base 102 presses against the end 12*a* of the handle 12. A strap 106 may be mounted to the base 102 and may be configured to hold the mop fibers 14 securely to the base 102. Once the stem 104 of the connector 100 is inserted into the handle 12, a retaining clip 110 may be inserted into the hole 19 in the handle 12 and the hole 108 in the stem 104 (as depicted in FIGS. 5, 6, 8 and 9) so as to prevent the connector 100 from twisting within the end of the handle or being removed from the handle 12.

As can be appreciated, the connector 100 is provided to secure one end of the mop fibers 14 to the end 12*a* while the other end of the mop fibers 14 is mounted to the collar 16, which is free to slide up and down and rotate about the handle 12 so that the desired wringing action may be accomplished with the mop fibers 14. To help resist the twisting force applied to the connector 100, the first end 12*a* may include a non-circular recess and stem 104 may be configured so as to mate with the non-circular recess. In such an embodiment, the design of the stem 104 can help prevent the connector 100 from twisting when the collar 16 is twisted by the user.

Figure 3:
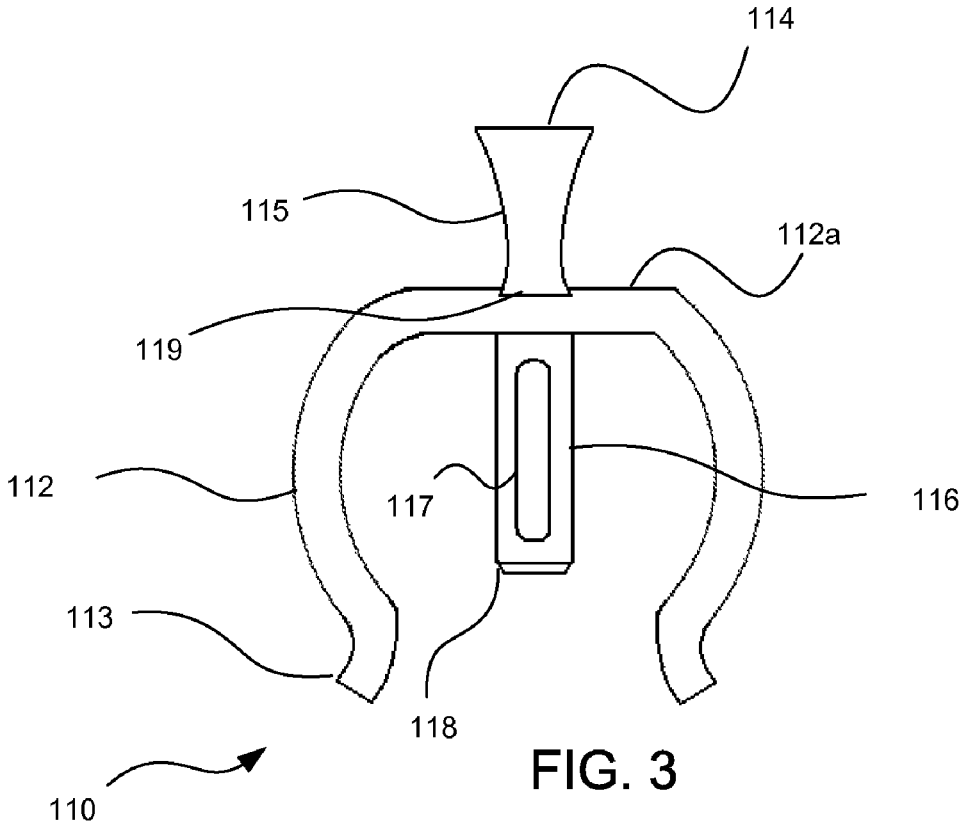
FIG. 3 is a front view of an illustrative embodiment of a retaining clip.
Figure 4:
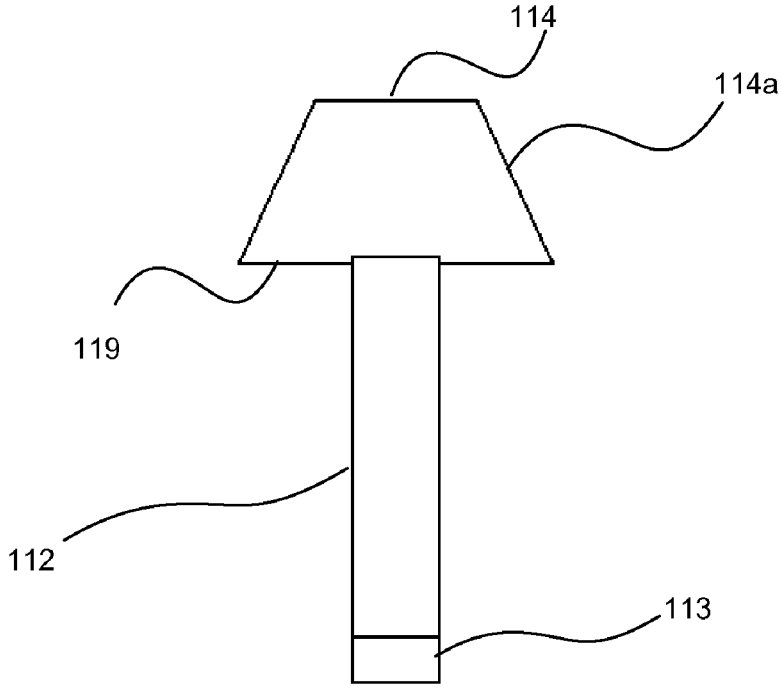
FIG. 4 is a side view of the retaining clip depicted in FIG. 3.

The retaining clip 110, of which an embodiment is depicted in FIGS. 3 and 4, includes a semi-circular band 112 that supports a post 116. The post 116 may be inserted into the holes 19, 108. Once inserted into the holes 19, 108, the post 116 can prevent the connector 100 from rotating and also can prevent the connector 100 from being removed from the end 12*a*. The retaining clip 110 can be made of any desirable material, such as a plastic that has a suitable strength and flexibility so that once the retaining clip 110 is installed, the semi-circular band 112 wraps partially around the handle 12 and biases the retaining clip 110 toward the installed position.

To aid in the insertion and removal of the retaining clip 110, a tab 114 may be provided with a gripping surface 115, such as a concave surface. In operation, a user may readily grip the tab 114 between the user's fingers and insert or remove the retaining clip 110 from the holes in the handle and connector. To facilitate gripping, the top surfaces 112*a* of the bands may be flat at the base of the tab 114.

It should be noted that the tab 114 can be configured so as to include sloped side walls 114*a* that angle inwardly as they extend from the band, as depicted in FIGS. 4 and 5. While not required, the sloped side walls 114*a* provide the advantage of minimizing the possibility of a mop fiber 14 becoming hooked on and wrapped around the tab 114. It should be noted that any desirable slope may be used and in an embodiment the angle of the slope may vary.

In addition to the use of a sloped side wall 114*a*, if desired the tab 114 may include shoulders 119 that extend beyond the width of the band and below the top surface 112*a* (as depicted in FIGS. 3 and 4) of the semi-circular band 112. In an embodiment, this allows the undersides of the shoulders of the tab 114 to be positioned essentially flush with the handle 12 when installed. An advantage of this configuration is that the reduced space between the tab 114 and the handle 12 acts to further minimize the possibility of mop fibers 14 being inadvertently wrapped or trapped between the tab 114 and the handle 12.

The post 116 may include a recessed portion 117 so as to provide a more uniform wall thickness for the retaining clip 110. The post may also include a taper 118 so as to ease insertion of the post into the holes 18 and 108.

When a user desires to remove or replace the mop fibers, the user may first grip the concave gripping surface 115 of the tab 114 with the user's thumb and forefinger and remove the retaining clip 110. Feet 113 at the ends of the bands 112 may facilitate loosening of the bands from about the handle when removing the retaining clip. The feet may also facilitate installation of the retaining clip 110. The feet may have any shape and size; however, smaller, more rounded feet may minimize the possibility of the mop fibers 14 becoming caught on the feet 113. In an embodiment such as is depicted in FIG. 3, for example, the band 112 smoothly transitions to the feet 113 so as to improve ease of assembly and to reduce the existence of sharp edges that could otherwise make assembly and disassembly more difficult. Next the user may remove the connector from the end 12*a* of the handle 12. Then the user may disengage the ends of the mop fibers from the collar 16. In this manner, the user may remove the mop fibers 14 from the handle 12. To reinstall the mop fibers 14, the above process may be reversed.

Figure 7:
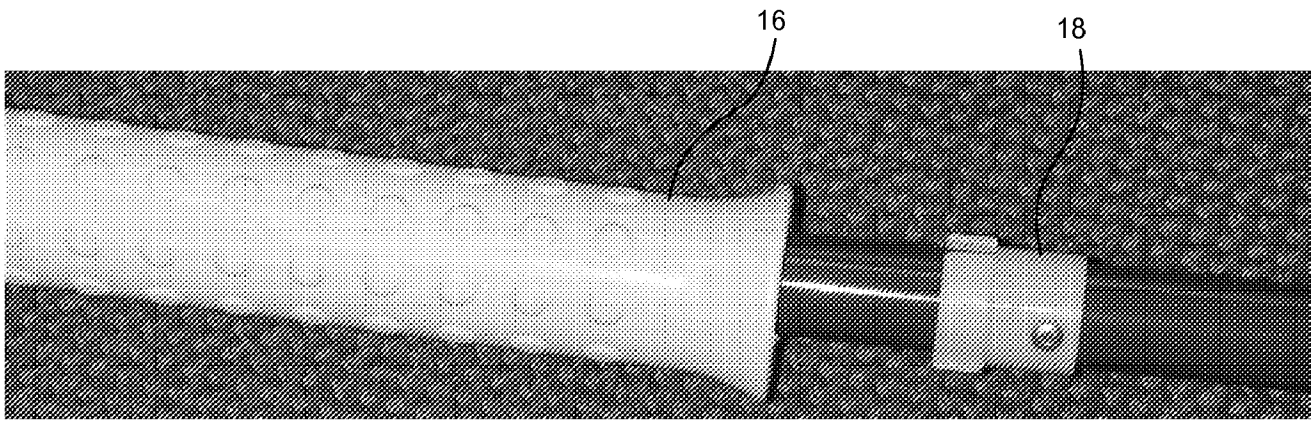
Figure 8:
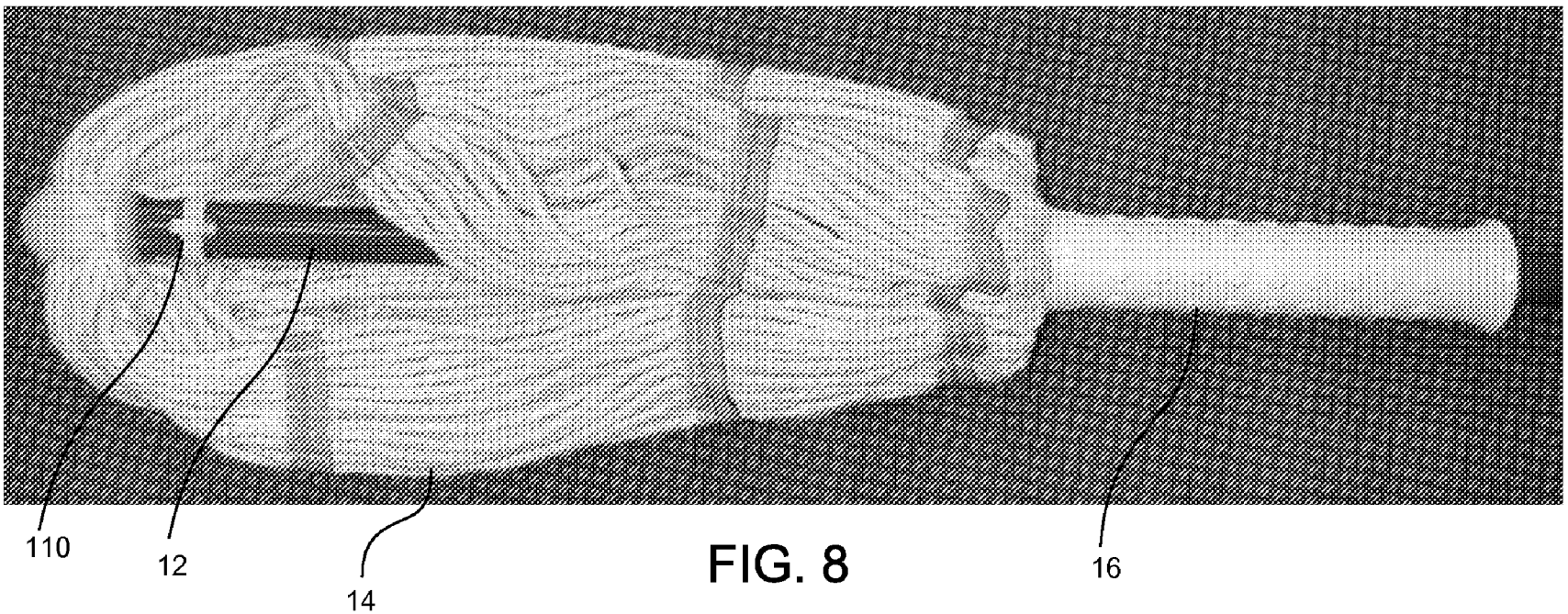
Figure 9:
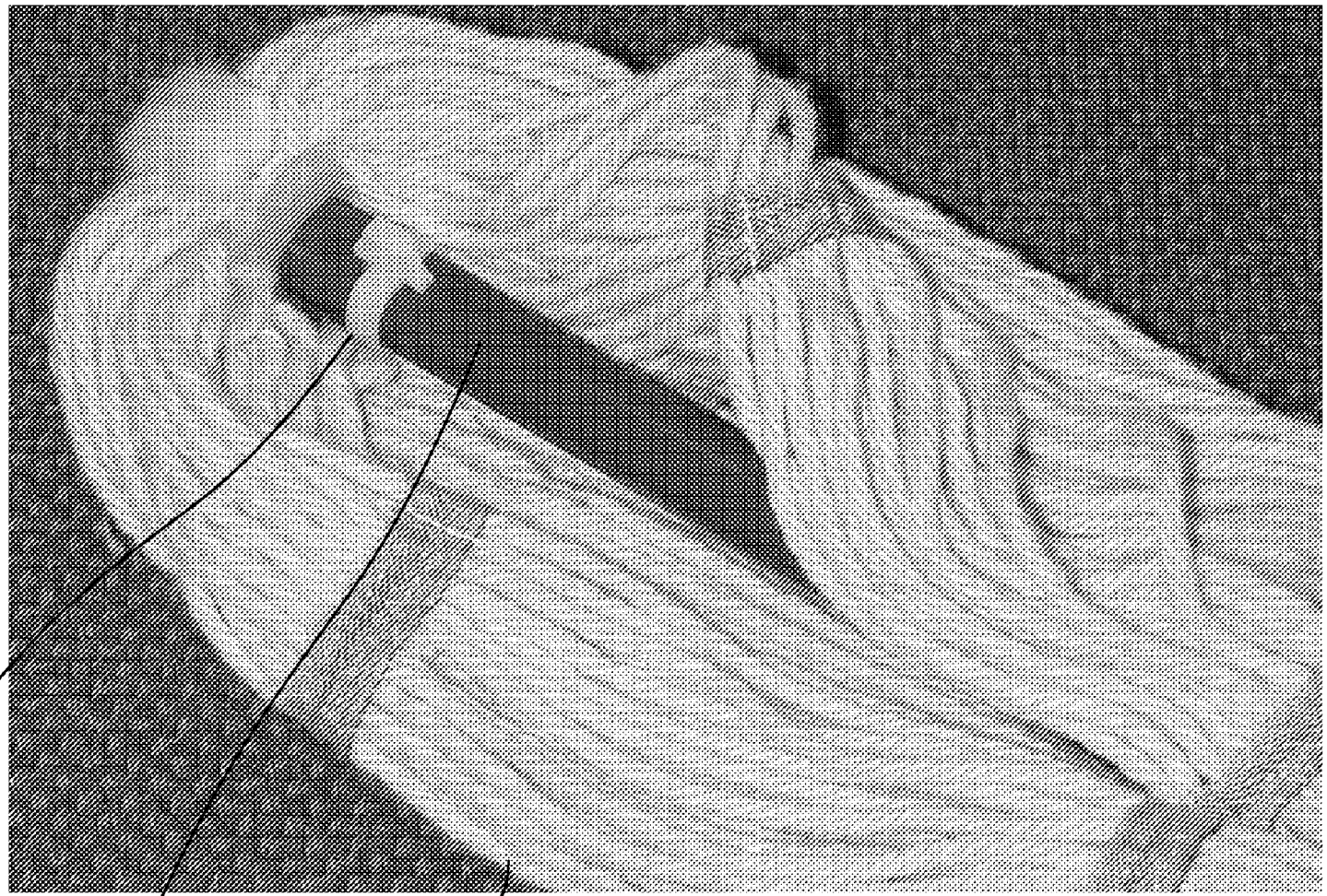
Figure 10:
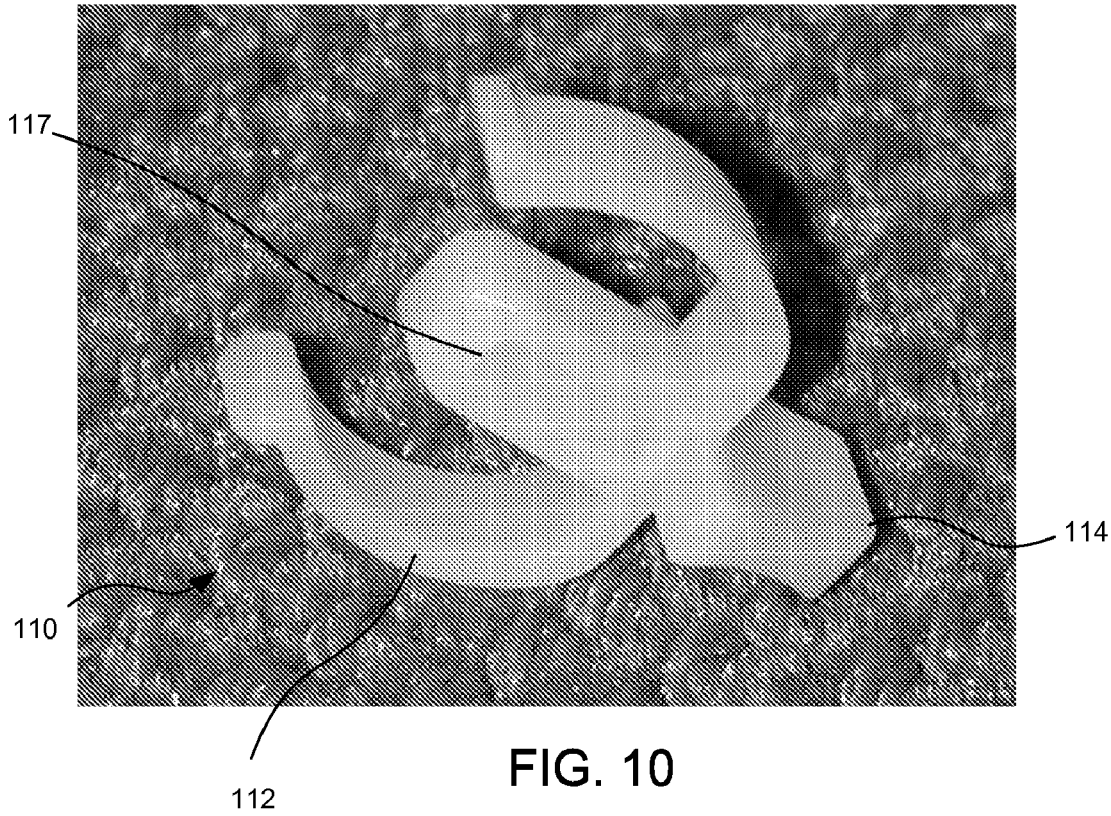
FIGS. 10-13 are isometric views of an illustrative embodiment of a retaining clip.
Figure 11:
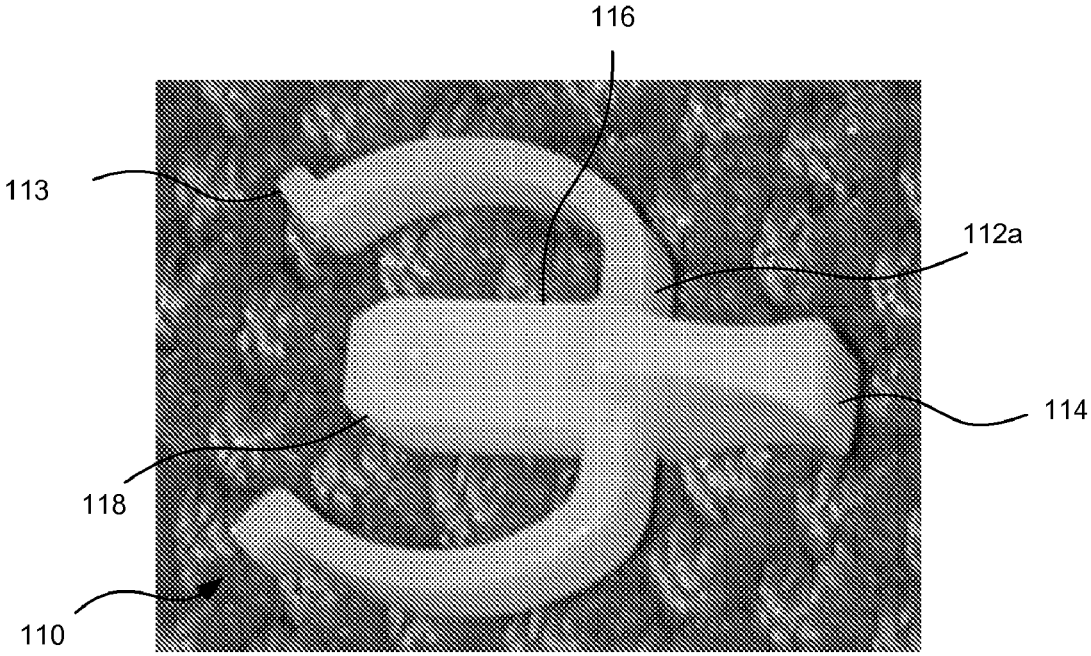
Figure 12:
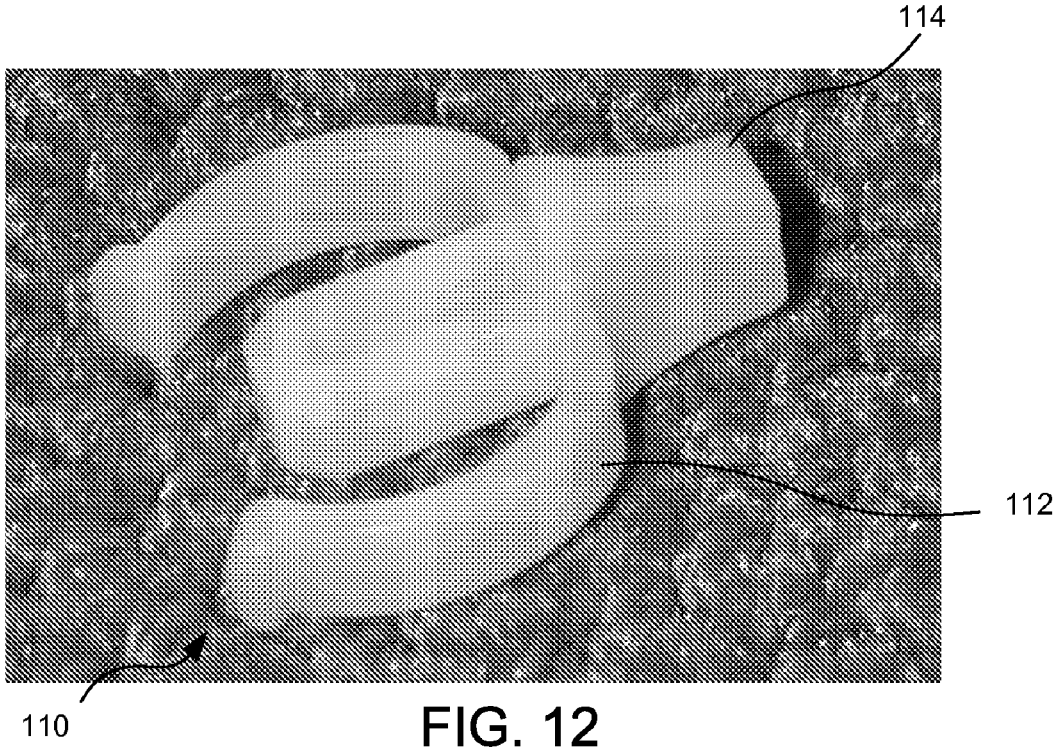
Figure 13:
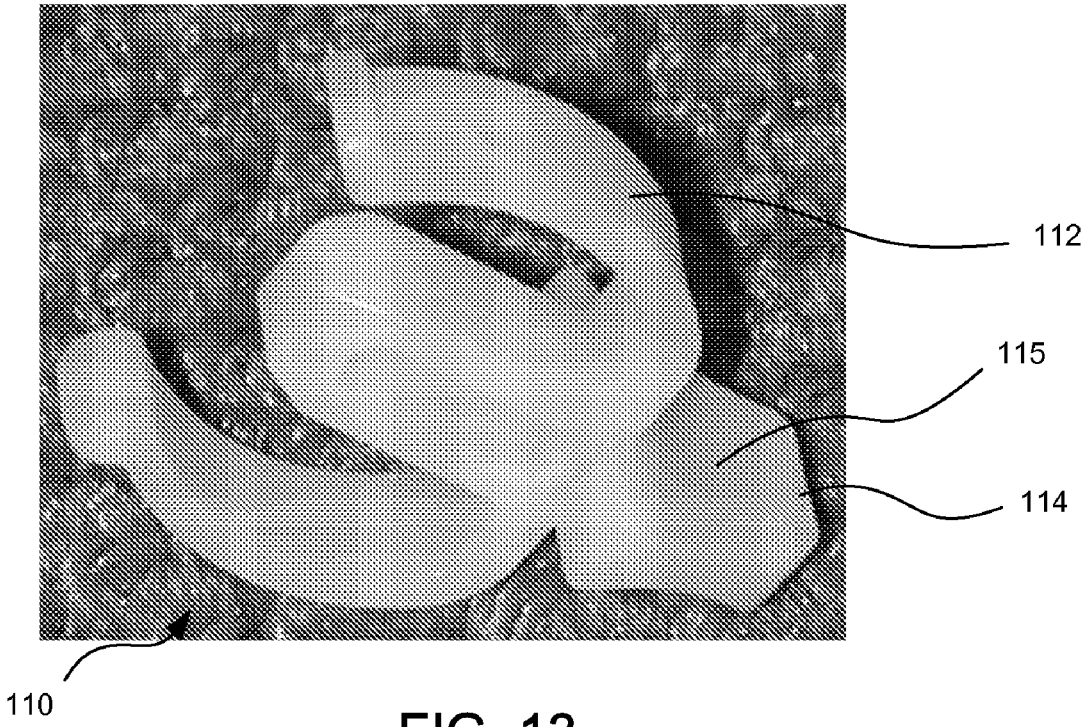
Figure 14:
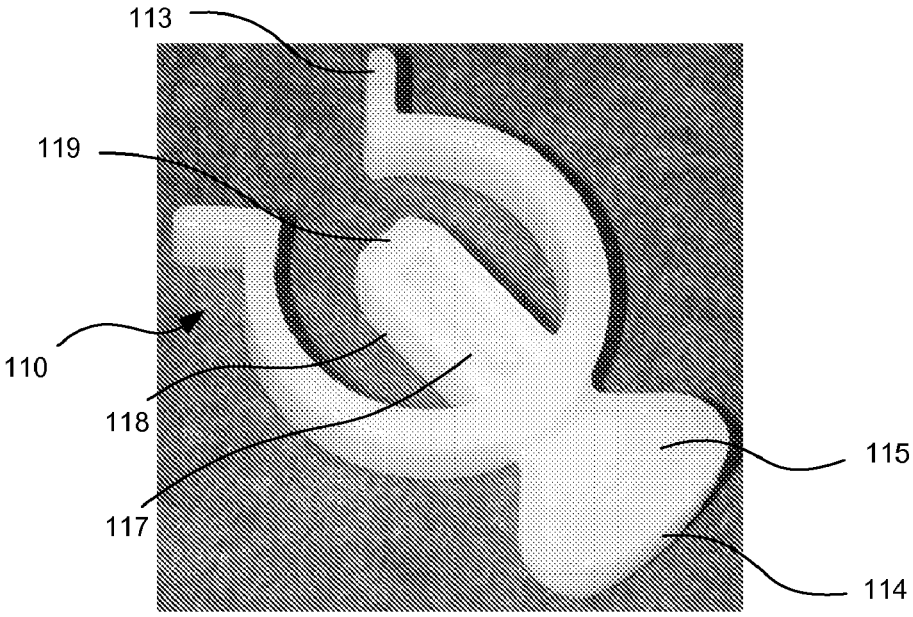
FIG. 14-17 are isometric views of an alternative illustrative embodiment of a retaining clip.
Figure 15:
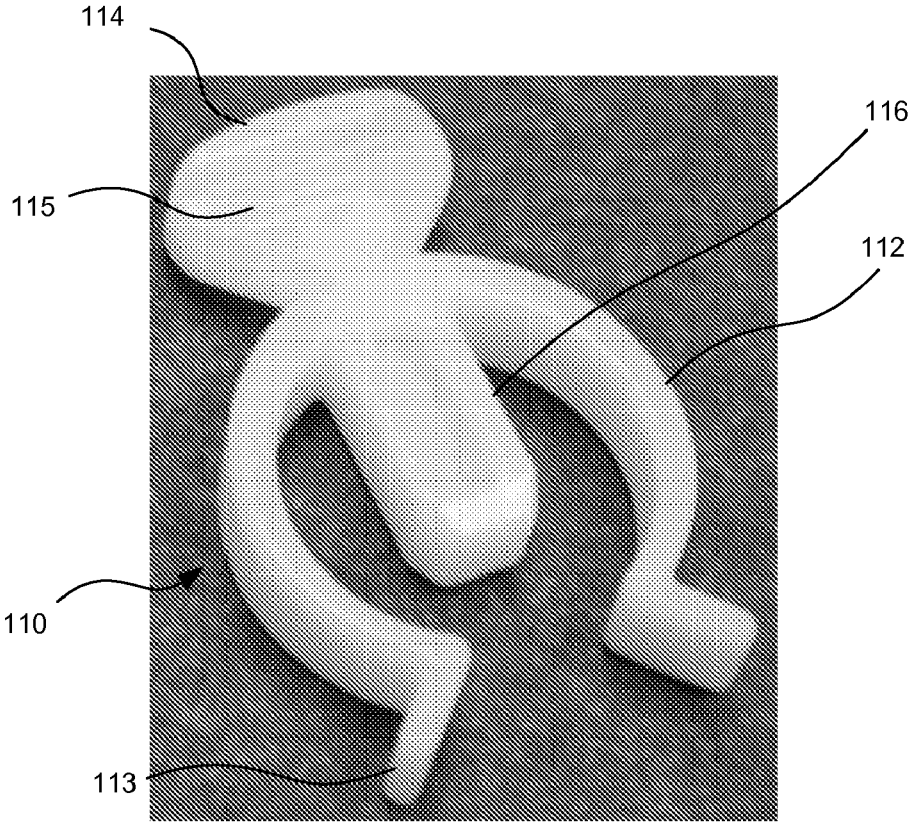
Figure 16:
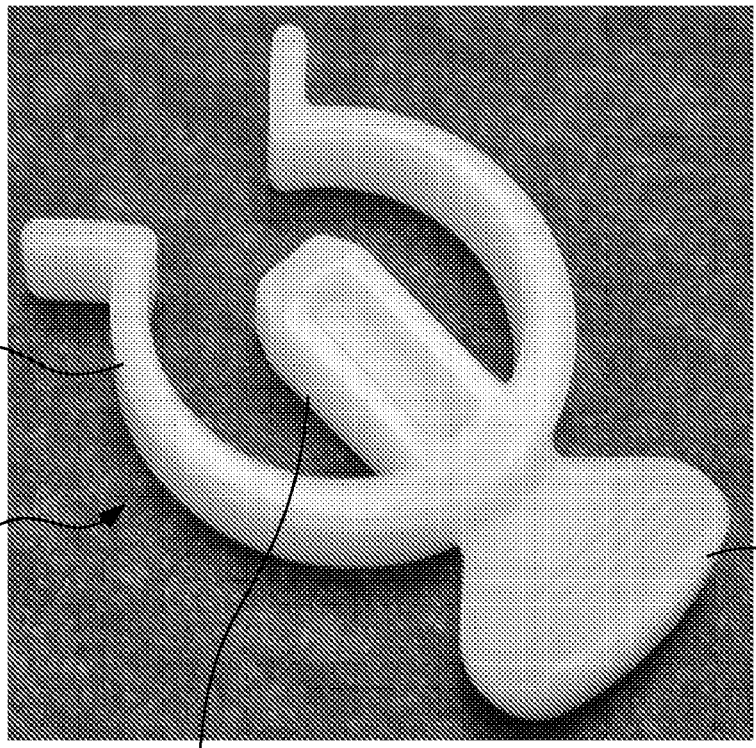
Figure 17:
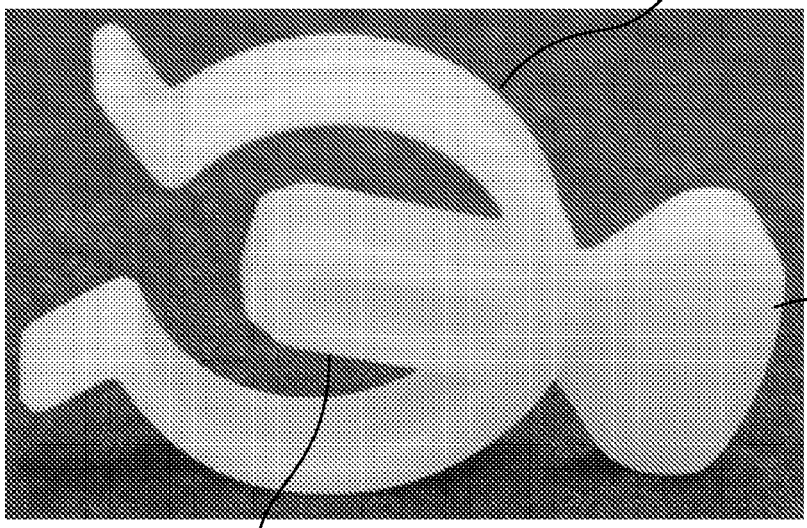

Referring next to FIGS. 6 through 9, photographs of an illustrative embodiment of a twist mop are provided. FIG. 6 illustrates an embodiment of a mop assembly. FIG. 7 illustrates an embodiment of a collar and a ratcheting clip. FIG. 8 is a front view of an embodiment of a mop head showing the assembly of the mop handle, mop fibers, connector, retaining clip and collar. FIG. 9 is an enlarged view of the mop head depicted in FIG. 8, showing a retaining clip installed. FIGS. 10-13 show various perspective views of an embodiment of a retaining clip. FIGS. 14-17 show various perspective views of an alternative embodiment of a retaining clip which, as can be appreciated from the FIGS. 14-17, includes an undulating gripping surface. It should be noted that the depicted Figures of the twist mop are merely representative of an illustrative embodiment and unless otherwise noted are not intended to limit the scope of the present invention.

The present invention has been described in terms of preferred and exemplary embodiments thereof. Numerous other embodiments, modifications and variations within the scope of the appended claims will occur to persons of ordinary skill in the art from a review of this disclosure.

I claim:

1. A twist mop system, comprising:

a handle including a recessed end with a first hole adjacent the end;

a collar configured to be rotatably positioned on the handle, wherein the collar includes ribs on an inner diameter that engage a ratcheting bracket so that the collar can only be twisted in one direction;

a connector configured to be inserted in the recessed end of the handle, the connector includes a second hole configured to correspond with the first hole in the handle when the connector is inserted;

a retaining clip configured to engage the first and second hole so as to prevent, in operation, disengagement of the connector from the handle, wherein the retaining clip includes a band for at least partially encompassing the handle, the band supporting a post that is configured to be inserted into the holes, wherein the band is configured to urge the post to remain in the holes once installed, the retaining clip further including a tab supported by the band, the tab including a gripping surface configured to aid removal of the retaining clip; and a plurality of mop fibers connected to the connector and the collar, whereby, in operation, rotating the collar with respect to the connector causes the mop fibers to be wrung.

2. The system of claim 1, wherein the band includes a plurality of feet configured to aid the insertion of the band over the handle.

3. The system of claim 1, wherein post includes a recessed portion and a tapered end.

4. The system of claim 1, wherein the tab includes a shoulder and further includes a plurality of sloped side walls extending from the shoulder.

5. The system of claim 4, wherein the band includes a substantially flat top surface adjacent the tab.

6. The system of claim 5, wherein the shoulder of the tab extends below the top surface of the tab.

7. The system of claim 6, wherein the tab is substantially perpendicular to the band.

8. The system of claim 1, wherein the gripping surface of tab is selected from the list consisting of a concave surface and an undulating surface.

9. A twist mop system, comprising:

a handle including a recessed end with a first hole adjacent the end;

a collar configured to be rotatably positioned on the handle, wherein the collar includes ribs on an inner diameter that engage a ratcheting bracket so that the collar can only be twisted in one direction;

a connector including:

a stem configured to be inserted in the recessed end of the handle, a base configured to press against the recessed end of the handle when the stem is inserted into the recessed end of the handle, and a second hole configured to correspond with the first hole in the handle when the stem is inserted into the recessed end of the handle;

a retaining clip configured to engage the first and second hole so as to prevent, in operation, disengagement of the connector from the handle, wherein the retaining clip includes a band for at least partially encompassing the handle, the band supporting a post that is configured to be inserted into the holes, wherein the band is configured to urge the post to remain in the holes once installed, the retaining clip further including a tab supported by the band, the tab including a gripping surface configured to aid removal of the retaining clip; and a plurality of mop fibers connected to the connector and the collar, whereby, in operation, rotating the collar with respect to the connector causes the mop fibers to be wrung.

10. The system of claim 9, wherein the band includes a plurality of feet configured to aid the insertion of the band over the handle.

11. The system of claim 9, wherein post includes a recessed portion and a tapered end.

12. The system of claim 9, wherein the tab includes a shoulder and further includes a plurality of sloped side walls extending from the shoulder.

13. The system of claim 12, wherein the band includes a substantially flat top surface adjacent the tab.

14. The system of claim 13, wherein the shoulder of the tab extends below the top surface of the tab.

15. The system of claim 14, wherein the tab is substantially perpendicular to the band.

16. The system of claim 9, wherein the gripping surface of tab is selected from the list consisting of a concave surface and an undulating surface.

* * * * *